US008181809B2

(12) United States Patent
Strube

(10) Patent No.: US 8,181,809 B2
(45) Date of Patent: May 22, 2012

(54) GAS-TIGHT AND LIGHT-TIGHT CLOSURE FOR A CONTAINER

(75) Inventor: Lutz Strube, Konigslutter (DE)

(73) Assignee: Ball Packaging Europe GmbH, Ratingen (DE)

( * ) Notice: Subject to any disclaimer, the term of this patent is extended or adjusted under 35 U.S.C. 154(b) by 994 days.

(21) Appl. No.: 11/994,439

(22) PCT Filed: May 13, 2006

(86) PCT No.: PCT/DE2006/000831

§ 371 (c)(1),
(2), (4) Date: Jun. 2, 2008

(87) PCT Pub. No.: WO2007/003149

PCT Pub. Date: Jan. 11, 2007

(65) Prior Publication Data

US 2008/0245806 A1 Oct. 9, 2008

(30) Foreign Application Priority Data

Jul. 2, 2005 (DE) ..... 10 2005 030 982

(51) Int. Cl.
*B65D 51/16* (2006.01)
*B65D 45/02* (2006.01)

(52) U.S. Cl. ..... 220/254.1; 220/231; 220/305; 220/316

(58) Field of Classification Search ..... 220/254.1, 220/305, 802, 281, 316, 231
See application file for complete search history.

(56) References Cited

U.S. PATENT DOCUMENTS 905,652 A 12/1908 Comings
1,360,911 A * 11/1920 Flanigan ..... 215/358
1,491,325 A * 4/1924 Thomas, Jr. ..... 220/305
(Continued)

FOREIGN PATENT DOCUMENTS

BE 461516 12/1945
(Continued)

OTHER PUBLICATIONS

English language translation of German Office Action dated Jun. 2, 2008 issued in related German Patent Application No. 102005030982.8.

(Continued)

*Primary Examiner* — Mickey Yu
*Assistant Examiner* — Niki Eloshway
(74) *Attorney, Agent, or Firm* — Sheridan Ross P.C.

(57) ABSTRACT

In order to provide a reversible closure for containers which are subjected to an internal pressure in accordance with the invention there is proposed a closure device (200) comprising a deformable stretchable planarly extending cover (205) which can be moved into at least two operating positions, wherein the cover is aligned in a first operating position with the opening of the container and in a second operating position it undercuts the opening of the container over the entire periphery with a peripheral edge portion (222) so that the undercutting region (33) on the cover and the undercut region on the container form complementary sealing surfaces for gas-tightly and liquid-tightly closing the opening. The closure device further has an actuable means (260) for applying a force to the cover for deformation of the cover in such a way that it is deformable from one of the two operating positions into the other operating position.

22 Claims, 6 Drawing Sheets

U.S. PATENT DOCUMENTS

Figure 1A:
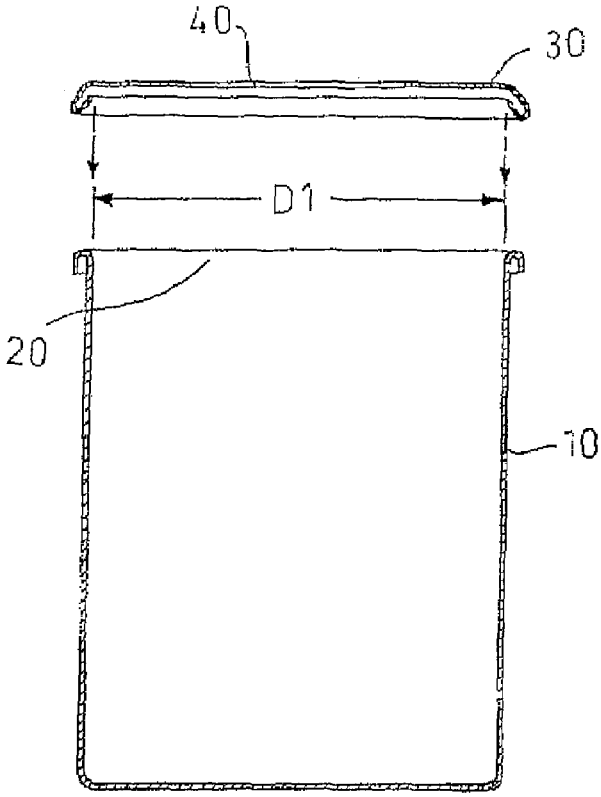

| | | | | | |
|---|---|---|---|---|---|
| 2,671,574 | A | * | 3/1954 | Wolfe | 220/234 |
| 2,782,958 | A | | 2/1957 | Hurley | |
| 3,080,993 | A | | 3/1963 | Livingstone | |
| 3,163,311 | A | | 12/1964 | Cornelius | |
| 3,756,480 | A | * | 9/1973 | Swett et al. | 222/484 |
| 3,788,512 | A | | 1/1974 | Brahler | |
| 4,157,764 | A | * | 6/1979 | Moller | 220/260 |
| 4,387,825 | A | * | 6/1983 | Parent | 220/234 |
| 4,747,511 | A | * | 5/1988 | Dutt et al. | 220/254.2 |
| 5,855,288 | A | * | 1/1999 | Dallas, Jr. | 215/228 |
| 7,513,381 | B2 | * | 4/2009 | Heng et al. | 220/238 |

FOREIGN PATENT DOCUMENTS

| | | |
|---|---|---|
| DE | 1072126 | 12/1959 |
| DE | 1914314 | 10/1969 |
| DE | 1532480 | 4/1970 |
| DE | 3535554 | 4/1987 |
| DE | 3902500 | 8/1990 |
| FR | 924856 | 8/1947 |
| GB | 943325 | 12/1963 |

OTHER PUBLICATIONS

International Search Report dated Dec. 27, 2006 issued in related International Patent Application No. PCT/DE2006/000831.

International Preliminary Report on Patentability dated Feb. 7, 2008 issued in related International Patent Application No. PCT/DE2006/000831.

* cited by examiner

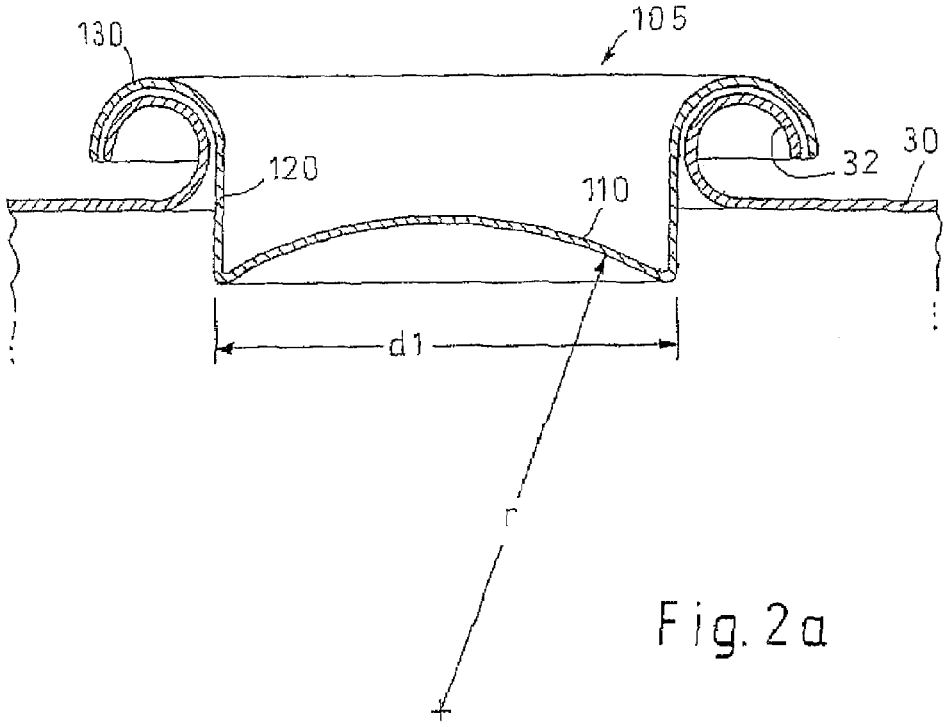
Fig. 2a
Fig. 2b
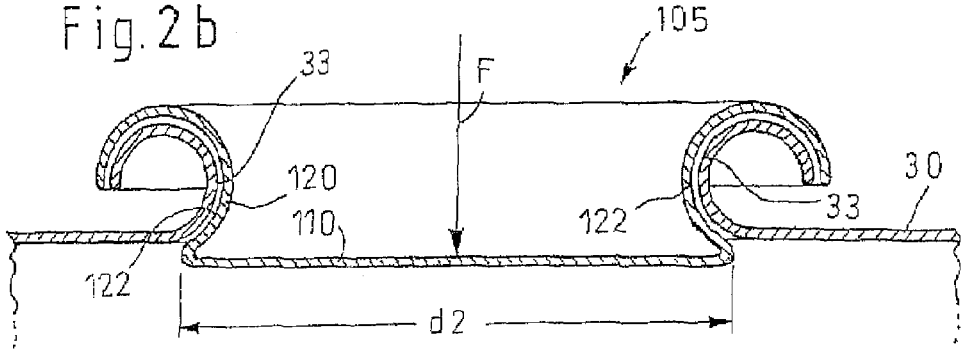

30
270
32
230
261
251
264
260
263
262
200
225
252
250
205
210
220
223

30
270
32
33
230
222
251
264
225
252
262
250
200
263
205
260
210
220
261
223

GAS-TIGHT AND LIGHT-TIGHT CLOSURE FOR A CONTAINER

The invention concerns a closure device for reversibly closing an opening on a container and an associated container for co-operating with such a closure device as well as a corresponding method of reversibly closing the opening on the container.

Containers such as liquid containers are used in many different ways both in the private sector and also in the business sector. The containers are generally provided with a closure which must satisfy particular demands depending on the respective specific use involved. For example a container can be subjected to pressure by virtue of the content thereof such as a carbonated liquid, and that entails corresponding demands both on the container and also on the closure. In the case of the drinks cans which are to be given by way of example for such containers, there is the problem of making the closure gas-tight and liquid-tight. As the consumer at least partially removes the closure element from the opening prior to consumption the closure element must be movable relative to the container in an outward or inward direction and possibly also removable. The fact that containers subjected to an internal pressure have a tendency for the closure element to be pushed open however causes difficulty in designing the closure element in that way.

In conventional drinks can closures the closure element includes a cover tongue portion, the opening being the known drinking opening. The closure element is removed from the opening by breaking open a weakening line. In that case the closure element is pressed against the internal pressure into the interior of the container upon being opened. That is achieved in the case of the conventional closures by a lever system having a high lever ratio. Ultimately such a closure element which is used in particular for conventional drinks cans only affords an irreversible opening procedure and the container cannot therefore be re-closed.

In that respect the object of the invention is to provide a reversible closure for containers which are subjected to an internal pressure, that is to say a closure which is re-closable.

That object is attained in a surprisingly simple fashion by a closure device having the features of claim 1 and a container for co-operation with such a closure device as set forth in claim 22.

The closure device according to the invention includes an elastically deformable and planarly extending cover which can be moved into at least two operating positions or situations, wherein in a first operating position of the cover it is aligned with respect to the opening of the container and in a second operating position the cover undercuts the opening of the container over the full periphery thereof, with a peripheral edge portion, so that the undercutting region on the cover and the undercut region on the container form complementary sealing surfaces for gas-tightly and liquid-tightly closing the opening, and an actuable means for applying a force to the cover for bending the cover in such a way that it is deformable from one operating position into another.

The closure device according to the invention can in principle be used for all containers which are subjected to pressure, irrespective of the container material, that is to say for example for glass, plastic or also metal sheet containers. Furthermore the closure device according to the invention is also not limited to a given form of container, for example the device can be used for barrel- or drum-shaped, can-shaped or also bottle-shaped containers. The closure device according to the invention can in principle also be applied to any design configurations for the opening, for example in relation to circular or oval openings. As the cover of the closure device is of such a design configuration that in an adjustable operating position it undercuts an inner edge of the container over the full periphery thereof, this provides for sealing integrity in respect of the container opening, which improves with a higher internal pressure, as when a higher internal pressure obtains the undercut region on the container and the undercutting region on the cover are pressed against each other with a higher force. In that respect the closure device according to the invention together with the associated container represents a self-sealing system.

In contrast to conventional reversible closure devices such as for example a screw closure or a cylindrical rubber member which can be introduced into the neck of a bottle and which is gripped at its end faces and by the application of force to the two end faces, by virtue of the volume forces occurring in the peripheral region, is pressed against the neck of the bottle, the closure device according to the invention affords at least the possibility of a small structural height so that stackability of the container can be afforded, in particular when the container is of a suitable design configuration. That represents a not inconsiderable advantage in terms of storage and transport of the product in the container.

Desirable materials for the cover have the property that they are elastically deformable, that is to say stretchable. That property can be afforded for example by certain plastic materials. The necessary elastic properties are enjoyed for example by the thermoplastic materials polypropene (PP) and polyethene (PE). An elastomer can also be used as the material for the cover.

In order to keep down the demands on the material of the closure device or the cover in regard to its stretchability or elasticity, it can be provided that the cover in the first operating position can be axially introduced at least portion-wise into the opening so that the deformation which is then necessary by bending does not have to be excessively great in order to produce the described positively locking engagement between the cover and the edge of the opening on the container. That operation of introducing the cover can be effected for example by a purely translatory movement of the cover into the opening so that in that case no deformation or bending force has to be applied to attain the first operating position.

In order to make the procedure involved in closing the opening on the container particularly simple for the user to perform, it can be provided that the cover in the transition between the two operating positions performs bending deformation without tilting or axial displacement relative to the container opening. For this embodiment, the user only has to apply the force necessary for deformation of the cover without additionally having to perform a rotary movement or a translational movement with the cover, which greatly facilitates handling.

It may be desirable if in the first operating position of the cover it is force-free, that is to say no external force acts on the cover. In that respect, no potential energy is stored in the cover in that case, for elastic deformation of the cover upon cessation of the external force. Accordingly such a potential energy can be stored in the cover when moving into the second operating position: starting from the first operating position of the cover elastic bending deformation is produced at the cover by the application of the external force to the cover for moving it into the second operating position, that elastic bending deformation producing a return force which acts in opposition to the external force.

It may be particularly advantageous if the design configuration of the closure device according to the invention is such that with the removal of the external force on the cover the potential energy introduced into the cover leads to a return of the cover into its first operating position, that is to say the cover is automatically returned to its configuration which corresponds to the first operating position, and that facilitates handling of the closure device according to the invention.

In another embodiment however it can also be provided that the cover is transferred from the sealing operating position by the application of an external force, for example a pulling force, to move into the first operating position in which the cover is aligned with respect to the opening of the container and for example can be removed from the container.

Depending on the respective configuration involved it may be desirable if the force means acts permanently on the cover to maintain the sealing operating position of the cover (second operating position).

It may be desirable if the container, to afford the opening, has an outwardly implemented peripheral rolled configuration. Such a rolled configuration can be produced in a simple manner for example if the container comprises metal sheet. The rolled configuration can serve in particular for connection to the closure device according to the invention. If the opening of the container is provided in its boundary by a portion of plastic material or glass, a shaped material configuration in the manner of a bead disposed externally in relation to the container, around the opening, can advantageously also be provided as a connecting element in relation to the closure device according to the invention. In this respect the specified features of 'rolled configuration' and 'bead' in the region of the container opening are to be deemed to involve the same action. They both represent an approximately cylindrical configuration around the container opening, which is in engagement with the closure device at least in an operating position of the cover. The man skilled in the art will see here a large number of possible design configurations, depending on the container material or the material constituting the region of the container which defines the opening and therewith the undercut region on the container for affording the sealing surface for the cover.

In a particularly desirable embodiment the cover in the first operating position is of a pot-like configuration with a bottom portion and a wall portion extending substantially normal to the container opening.

It may be desirable if the bottom portion of the pot-shaped cover in the first operating position of the cover is shaped concavely towards the interior of the container. That affords the possibility of achieving an increase in area in the bottom region of the cover by virtue of the application of a force to the bottom to produce the undercut configuration, and in addition to store deformation energy which can be used to return the cover to the first operating position when the external force on the cover is removed.

Particularly for the purposes of fixing to a rolled portion or bead, as referred to hereinbefore, in the region of the opening of the container, the wall portion of the container, at the end remote from the cover bottom portion, goes into an outwardly curved portion which bears against or can be caused to bear against the rolled configuration of the container opening. The curved portions, which bear against each other, of the cover and the container edge afford the advantage that, upon a change in shape of the cover, those contact surfaces are assured of coming to bear snugly against each other and for example no hooking engagement of the contact surfaces or the like can occur. In that respect upon spreading movement of the cover in the radial direction the cover is peripherally guided by the associated edge portion on the container.

In order to assist with bending of the cover into the desired cover configuration by virtue of an external force acting thereon there can be provided a guide device, in particular in the form of a disk, which rests on the cover on the side thereof remote from the container and co-operates with the cover. That guide disk is generally made from a material which is stable in respect of shape and can thus also prevent unwanted outward buckling or deformation of the cover when a high internal pressure occurs in the container.

To assist with the co-operation of the cover and the guide disk it is desirable if guide elements are arranged on the cover in particular in the region of the transition between the wall portion and the bottom portion, or in the lower region of the wall portion, which co-operate with contact surfaces on the guide disk to assist with the spreading movement of the cover. Those guide elements can include for example ribs which extend axially with respect to the opening and which are desirably spaced peripherally on the cover in order not to impede the spreading movement of the cover. In a particular embodiment however it can also be provided that disposed on the cover in the lower region of the wall portion is a bead which extends around the entire periphery and which co-operates with a contact surface on the guide disk for supporting a spreading movement of the cover.

In accordance with the invention a large number of possible options can be used as the means for applying the force in order to deform the cover as described. For example it is possible to use a screw or a lever to exert a force on the cover. In that respect the force means can be fixed directly to the closure or can also be separate from the closure on the container.

In a particularly desirable embodiment there can be provided an actuating element having a pivotable eccentric lever which includes a gripping portion and a cam head which exerts a force on the cover for deformation thereof, in dependence on the pivotal position of the lever. For that purpose the pivot spindle can extend through the cam head, in which respect the spindle can be fixed to the cover, for example by means of a lug which comprises a comparatively stiff material and which is mounted to the cover wall portion and which extends inwardly. In that case the pivot spindle is displaced with respect to the central axis of the lever or the cam head is also not of a rotational shape so that it can exert on the cover, a force which is dependent on the pivotal position of the lever.

A particularly simple design configuration for the closure device according to the invention can be provided if the force means produces a force substantially in the normal direction of the opening, that is to say it is produced axially, the force being transmitted to the cover by way of the guide disk.

It is particularly desirable if the closure device according to the invention has a means for venting the container so that for example pressure equalisation can be carried out prior to removing the positively locking engagement between the cover and the container. It is possible in that way to prevent a high internal pressure during removal of the positively locking connection between the cover and the container giving rise to uncontrolled processes such as an unwanted escape of liquid by virtue of vigorous generation of gas or explosive separation of the closure device according to the invention from the container.

In regard to the possibility of venting the container it may be desirable if the means for venting the container has a passage in the cover and a corresponding passage in the guide disk, wherein both passages form a venting passage for the container, which is closed by an actuable valve device.

In order to avoid two actuating elements, one for the force means and one for the venting means, it can desirably be provided that the valve device is operatively connected to an actuating element for the force means. For example, in the case of an actuating lever as described hereinbefore, the cam head can have a groove which corresponds to the venting passage in dependence on the pivotal position of the lever.

In order to avoid the closure device being lost when putting the cover into the first operating position, depending on the respective design configuration involved, there can be provided a fixing means with which the closure device is fixed to the container non-losably and independently of the operating position of the cover. By way of example in a preferred embodiment the closure device can extend beyond a rolled configuration or bead on the container and can there be glued to the container or joined thereto in some other fashion.

As already described hereinbefore the closure device according to the invention can be used for a large number of containers. That also applies in particular to cylindrical metal cans such as drinks cans which are adapted to co-operate with the closure device according to the invention. By way of example the container can have a container body with a primary opening which is closed by a primary closure which itself in turn has an opening which is gas-tightly and liquid-tightly closable with the closure device according to the invention. Such a primary closure can be for example in the form of a surface portion (panel) of sheet metal which is joined to the container body by a folded seam, adhesive and/or soldering, wherein an inwardly disposed portion of the panel, which portion extends around the opening over the periphery thereof, represents a sealing surface for the portion of the cover, which engages thereover. That panel can have for example around the opening thereof a peripherally extending rolled configuration which can be brought into engagement with the closure device. The closure device can be glued to the panel in order to prevent the closure device from being lost.

In the method aspect the foregoing object of the invention is attained with a method of reversibly closing an opening on a container with a closure device having a deformable planarly extending cover, with the steps set forth in claim 27. In that procedure the cover is aligned outside the container with respect to the opening thereof and the cover is then deformed in such a way that with a peripheral edge portion it undercuts the opening of the container over the full periphery so that the undercutting region on the cover and the undercut region on the container form complementary sealing surfaces for gas-tight and liquid-tight closure of the opening.

Figure 1B:
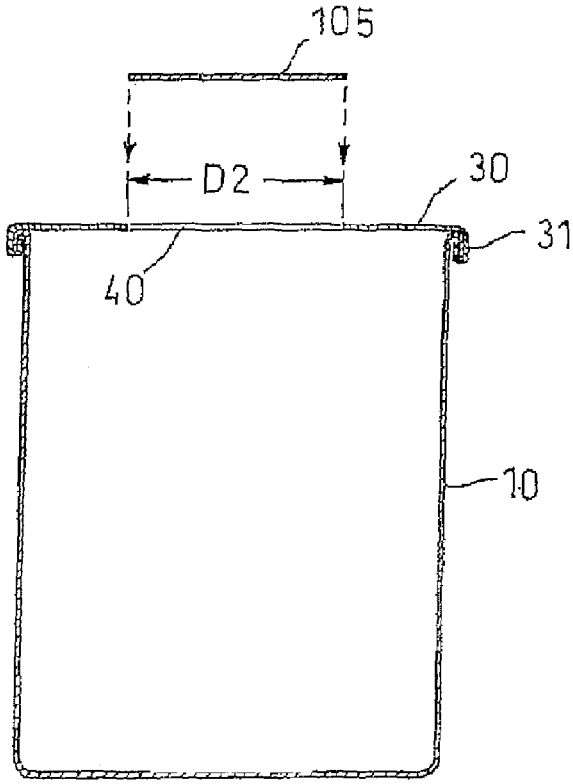
Figure 2C:
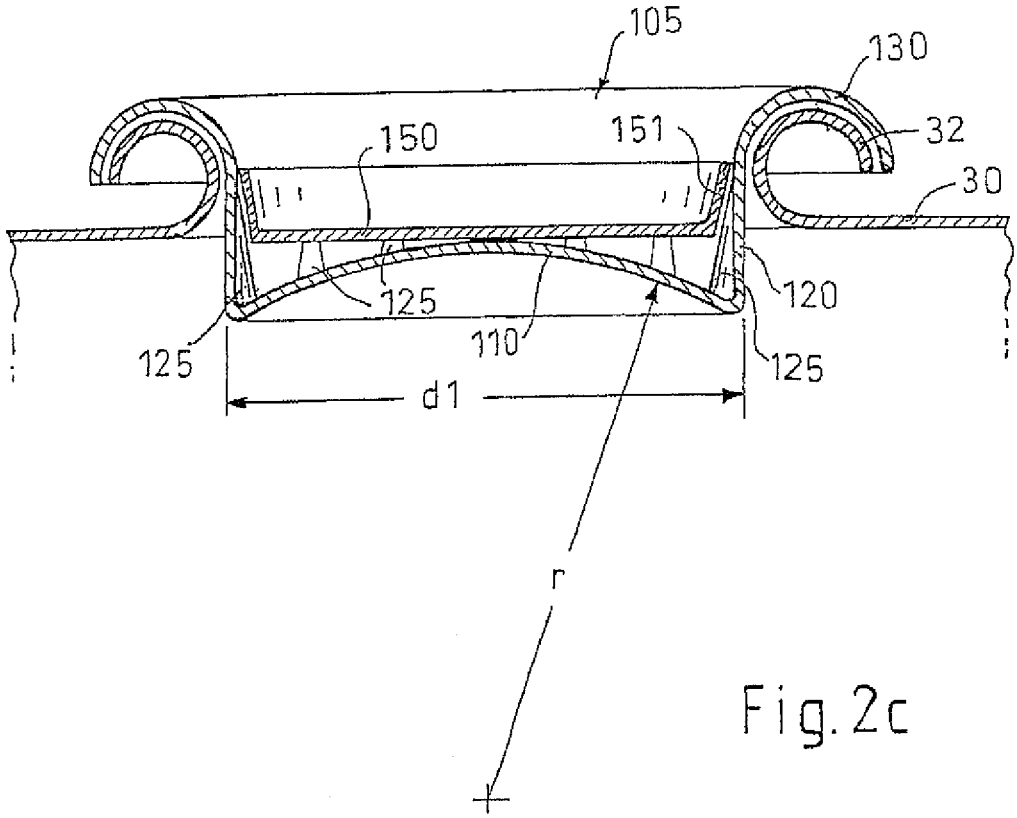
Figure 3A:
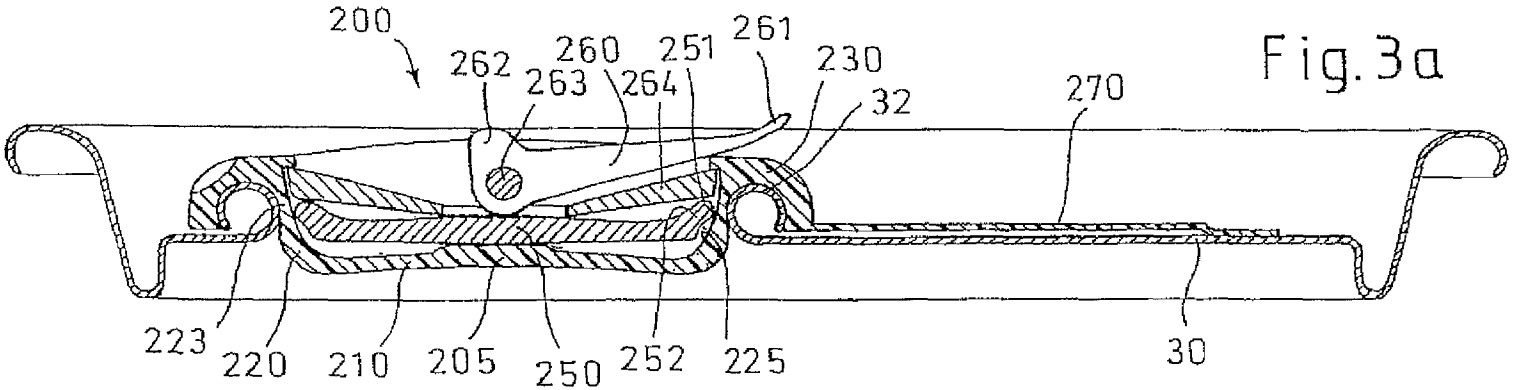
Figure 3B:
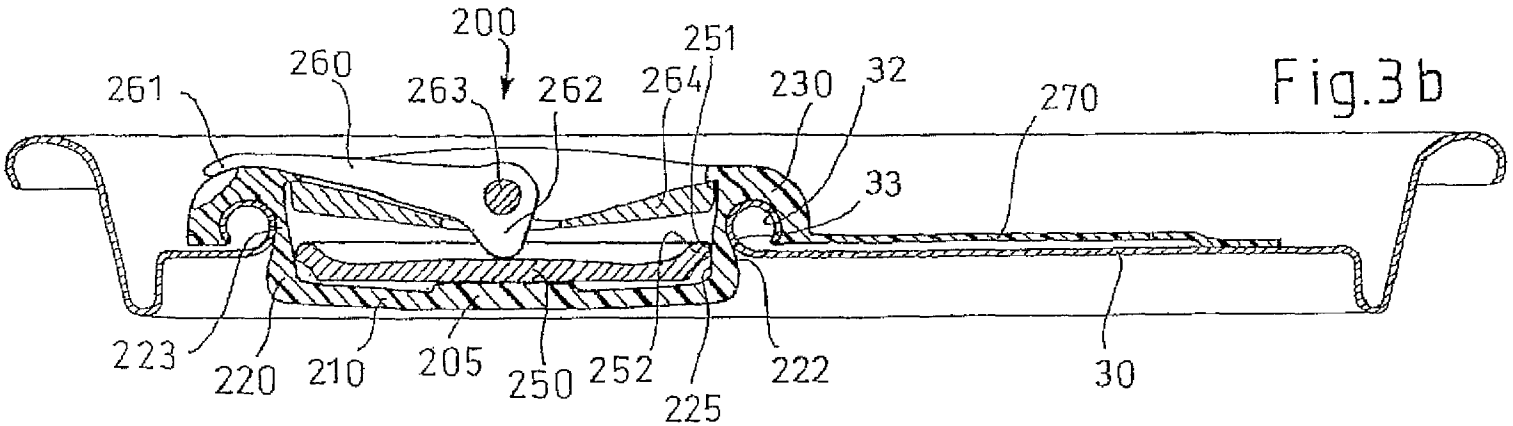
Figure 4:
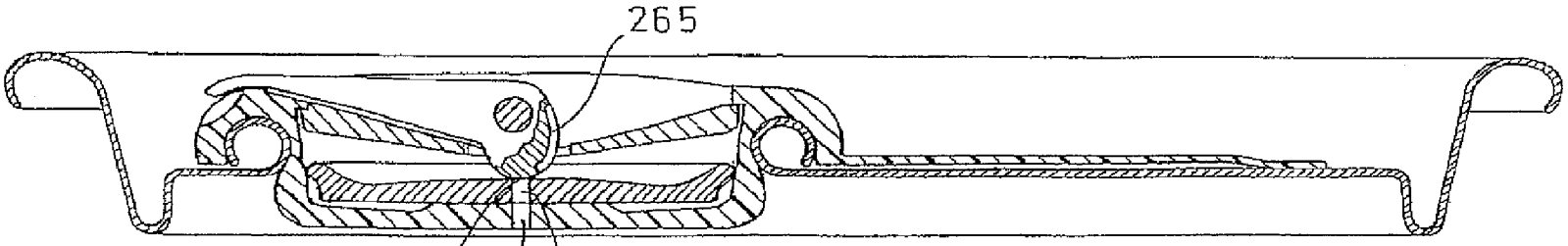
Figure 5:
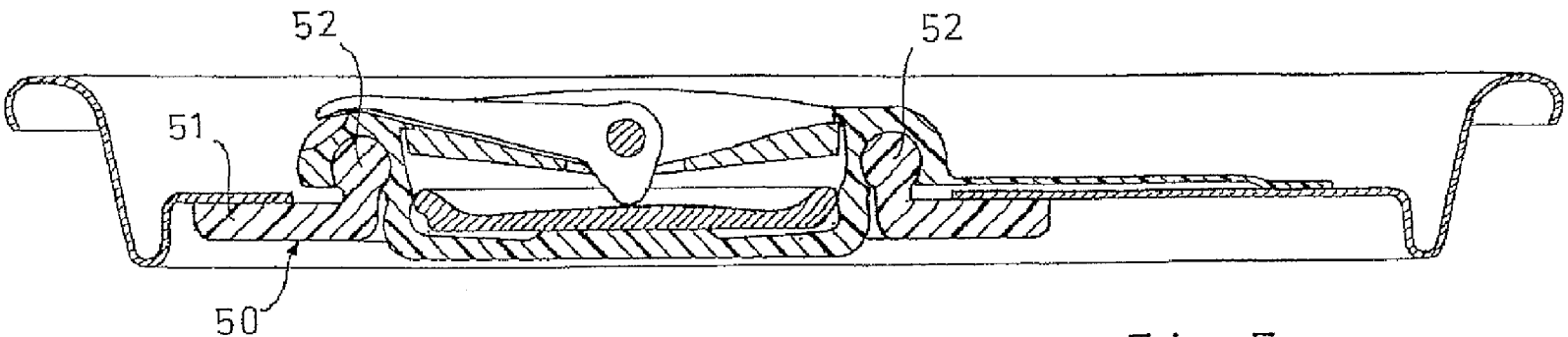
Figure 6A:
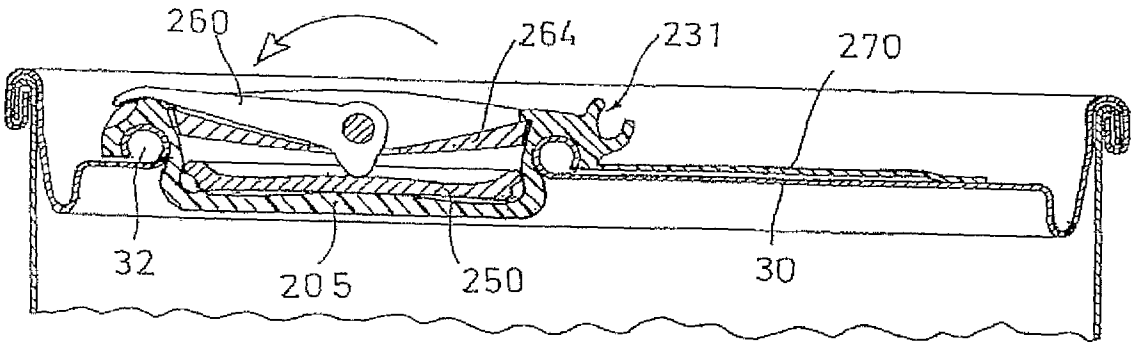
Figure 6B:
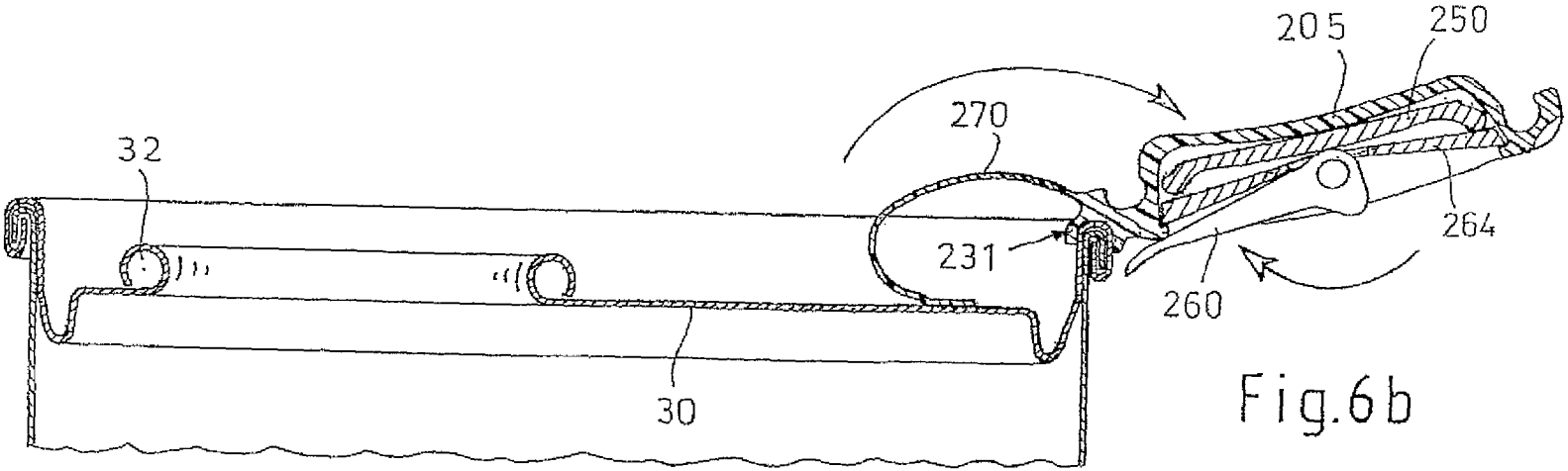

The invention is described hereinafter with reference to the accompanying drawings by the description of some embodiments and further advantageous features. In the drawings:

FIGS. 1*a* and 1*b* show a side view illustrating the structure in principle of a drinks can, FIG. 2*a* is a view showing the principle of a closure element according to the invention in a first operating position, FIG. 2*b* shows the closure element of FIG. 2*a* in a second operating position, FIG. 2*c* is a view showing the principle of a further closure element according to the invention, FIG. 3*a* is a view in section of a further embodiment of the closure element according to the invention in a first operating position, FIG. 3*b* shows the closure element of FIG. 3*a* in a second operating position, FIG. 4 shows an embodiment which is modified in relation to the closure element shown in FIGS. 3*a* and 3*b*, FIG. 5 shows a sectional view of a third embodiment of the closure element according to the invention, FIG. 6*a* shows a sectional view of a fourth embodiment of the closure element according to the invention in a second operating position, and FIG. 6*b* shows the closure element of FIG. 6*a* in a situation in which the closure element is pivoted away from the opening.

The invention is described hereinafter by reference to the example of various configurations of a closure element for a drinks can. A diagrammatic view showing the principle of such a drinks can is illustrated in FIGS. 1*a* and 1*b*. It includes a cylindrical container body 10 which is composed of a bottom and a peripheral surface portion. The container body 10 has an opening 20 of a diameter D1. To close that primary opening, there is provided a primary closure in the form of a plate-shaped surface portion or panel 30 which itself has an opening 40. The panel 30 and the container body 10 are liquid-tightly and gas-tightly connected together by means of a peripheral folded seam 31. The opening in the panel 40 of the circular diameter D2 is now reversibly closed with a closure element 105 of a configuration in accordance with the invention. In the described embodiment the container body 10 and the panel 30 are made from metal sheet.

To facilitate understanding, the structure of an embodiment of the closure element according to the invention is described with reference to FIGS. 2*a* through *c*, on the basis of the diagrammatic views shown therein. Illustrated therein is the panel 40 which closes the primary opening, wherein the edge portions thereof, which are towards the panel opening, are shaped to produce a panel rolled configuration 32. For that purpose the material properties of the sheet metal of the panel 30 are so set that such a rolled configuration 32 can be produced without fracturing the material. The closure element 105 according to the invention is now fitted into the panel opening, in a first operating position. In the view shown in FIG. 2*a* the closure element is of a pot-like configuration with a bottom portion 110 and a wall portion 120 which at the end goes into a curved portion 130 which bears against the panel rolled configuration 32. Like the rolled configuration 32 which is shown in section, the closure element 105 is of a rotationally symmetrical configuration, that is to say the rolled configuration 32 forms a support contact means extending around the panel opening over the full periphery thereof, for the pot-shaped closure element 105. The bottom 110 which is correspondingly of a cup-shaped configuration has a concavely curved surface of a radius r, towards the interior of the container. The closure element extends axially into the panel opening, in this respect the closure element in that region involving a surface extent of a diameter d1 which is ≦ the panel opening diameter D2, see FIG. 1. The closure element 105 is produced from elastic polyethene.

FIG. 2*b* shows the procedure involved in implementing the sealing operating position of the closure device. For that purpose, a force F is applied in the direction of the illustrated arrow, here extending axially with respect to the panel opening. Under the influence of that force F, the bend in the bottom portion 110 becomes progressively less and totally disappears in the extreme situation shown in FIG. 2*b*. As described above, the material of the closure element 105 is stretchable, in that respect the cup or pot configuration spreads in the bottom region to a diameter d2 which is greater than the diameter D2 of the panel opening. In that respect the closure element 105 in that operating position undercuts or engages behind the panel 30 in the opening 40 therein, see FIG. 1*b*. The wall portion 120 of the closure element adopts a curved configuration by virtue of the spreading movement, and bears snugly with the cover sealing surface 122 against the panel sealing surface 33. The two sealing surfaces co-operate for liquid-tight and gas-tight closure of the panel opening. If the container which is to be sealed is subjected to an internal pressure, that results in the closure element 105 being pressed against the panel 30, that is to say the closure is self-sealing.

If the force F acting from the exterior is removed the closure element 105 is moved automatically by virtue of the elastic force in the material from the sealing operating position shown in FIG. 2*b*, back into the non-sealing operating position shown in FIG. 2*a*. That function can be implemented as long as the deformation of the material remains within a range in which the material is elastic.

FIG. 2*c* is a view showing the principle of a further embodiment of the closure element according to the invention which is of a similar structure to that shown in FIGS. 2*a* and 2*b*. In that respect attention will be directed hereinafter primarily to the differences. The closure element again has a pot-like cover 105 which is shown here in the non-sealing operating position. In order to promote the spreading movement of the cover 105, described with reference to FIG. 2*b*, the closure element additionally has a guide device such as a guide disk 150 which extends over the radial extent of the cover to the wall portion 120 thereof and which rests on the cover. At a radially outwardly disposed position the guide disk 150 has a contact surface 151 which extends slightly inclinedly with respect to the axis of the opening and which co-operates with ribs 125 at the inner wall 120 of the cover 151. The ribs extend at peripheral spacings in slightly inclined relationship with the axis on the wall portion 120 and are produced integrally therewith. The guide disk 150 is made from a plastic material which is stable in respect of shape such as a thermosetting plastic material.

The external force for moving the cover into the sealing operating position acts in this embodiment on the cover 105 by way of the guide disk 150. As the contact surface 151 is parallel to the surface of the ribs 125 with a slight angle relative to the axis and the guide disk is moved axially by the application of the external force F, the contact of the guide disk and the ribs 125 promotes the spreading movement of the cover in the region of its bottom 110 (see FIG. 2*b*). The guide device 150 also serves in the sealing operating position of the cover to prevent the cover from bulging out by virtue of a high internal pressure, which otherwise could result in the cover leaking.

FIGS. 3*a* and 3*b* show another embodiment of the closure element according to the invention with a for example eccentric lever for applying the force for flexing the cover into the sealing operating position. As can be seen the closure element shown in FIGS. 3*a* and 3*b* is of a very similar structure or identical structure to the closure element shown in FIG. 2*c*, in regard to the guide device 250 and the cover 205. Reference will firstly be directed to the view shown in FIG. 3*a* illustrating the closure element in the non-sealing operating position. As essential components, it includes the bowl-shaped cover 205, the guide disk 250 and an eccentric lever 260 which, depending on the respective pivotal position, acts on the guide disk 250.

In the operating position of the cover 205 shown in FIG. 3*a*, it embraces the panel rolled configuration 32, with a curved portion 230 of the cover. The curved portion is in turn adjoined by a wall portion 220 in the form of a substantially cylindrical peripheral surface. The wall portion has a narrowing region 223 and goes into integrally formed ribs 225 downwardly in a direction towards the bottom 210 of the cover. The bottom portion extends substantially horizontally in the non-sealing operating position shown in FIG. 3*a*. A thickening in the central region serves for bearing against the guide device 250 which is of a disk-like configuration and which in the peripheral region has a radially outwardly extending flange 252 which co-operates with a contact surface 251 at the ribs 225 of the cover 205. Formed integrally on the curved portion 230 of the pot-shaped structure is a fixing strip 270 which extends at the outside surface of the panel 30 parallel thereto and is glued thereto. The aim and purpose of such a fixing strip is described in greater detail hereinafter. The eccentric lever 260 which is shown in FIG. 3*a* in a pivotal position in which it exerts no force on the guide disk 250 or the bottom region 210 of the cover 205 is mounted with its lever spindle 263 to a circular lug 264 which in turn is supported on the wall portion 220 of the cover 205. The eccentric lever 260 has a gripping portion 261 and a cam head 262 which is of an asymmetrical configuration relative to the lever spindle 263.

FIG. 3*b* now shows the arrangement illustrated in FIG. 3*a*, with the eccentric lever 260 turned over, so that the cover has been moved into its sealing operating position. As can be seen, when the eccentric lever 260 is pivoted over into the pivotal position shown in FIG. 3*b*, the force applied to the guide disk 250 or the cover 205 becomes progressively greater until reaching the position shown in FIG. 3*b* in which the peripheral region involving the maximum radial extent of the cam head comes to bear against the guide disk 250. In that respect the guide disk 250 and the wall region 220 or the bottom region 210 of the cover 205 move continuously into the positions or configurations shown in FIG. 3*b*. In that case the flange-like extension 252 moves downwardly on the rib 225 of the cover and urges that region outwardly so that the cover is spread in the lower wall region or in the bottom region thereof. The axial force on the bottom of the cover causes it to be also urged downwardly. The axial increase in length occurs substantially in the narrowing region 223, in that respect it is possible to avoid the curved region 230 of the cover coming out of engagement with the rolled configuration, by virtue of the axial force. The cover 205 then undercuts or engages behind the panel 30 in the wall region 220 so that the corresponding sealing surfaces 33 on the panel and 222 on the cover come to bear against each other. The guide disk, like the fixing lug 264, is made from a plastic material which is harder in comparison with the cover 205 in order to ensure the necessary stability in respect of shape. In the described embodiment the eccentric lever 260 is also made from the same material as the fixing lug 264.

The sealing closure position shown in FIG. 3*b* can be terminated by simply turning the lever 260 over into the pivotal position shown in FIG. 3*a*. In that operating position, the closure device can be easily removed from the container opening. For that purpose the portion 230 of the cover, which engages over the rolled configuration of the panel, can be brought out of engagement with the rolled configuration of the panel. As the cover comprises a soft elastic plastic material there is no need to apply a large amount of force for that purpose.

FIG. 4 shows a variant of the closure element which is designed in accordance with the invention and as is shown in FIGS. 3*a* and 3*b* and which affords the option of implementing pressure equalisation during opening or closing of the container. For that purpose the cover 205 has a venting hole 211 which corresponds to a corresponding venting hole 253 in the guide disk 250 so that ultimately this provides a venting passage which is passed outwardly from the interior of the container. In the pivotal position shown in FIG. 4 of the lever 260, corresponding to the sealing operating position of the closure, that venting passage is covered over by the peripheral region of the cam head 262 so that this peripheral region which acts as a closure surface 262 closes off the venting passage. As shown in section in the Figure the cam head, in the region of its peripheral surface, has a groove which corresponds to the venting passage when the lever is pivoted from the closure position shown in FIG. 4 into the open position.

FIG. 5 shows a further embodiment of a closure element according to the invention. In contrast to that shown hitherto, the closure element is not fixed to a rolled configuration of the panel of the drinks can but to an annular insert 50 having a peripheral flange 51 on which a peripheral bead 52 extends in a direction of about 90° with respect to the surface of the flange, with the closure element 205 engaging into the bead 52. The rolled configuration of the can end panel, which has been used in the previous embodiments, is here replaced by the bead on the insert 50. That insert is glued to the panel 30 in the overlap region. It will be appreciated that that glueing can also be implemented externally on the end panel. As the further structure of the closure element shown in FIG. 5 scarcely differs from the preceding one, there is no need for further description in relation to FIG. 5.

FIGS. 6*a* and 6*b* show a further embodiment of the closure element according to the invention having two particular features which will be discussed in detail hereinafter. FIG. 6*a* shows the closure element in the sealing position of the cover. Arranged in the curved portion 230 of the cover 205 at the outer periphery is a holding clip 231 which is of a corresponding configuration to an end panel folded seam. Both that holding clip 231 and also the fixing strip 270 already described hereinbefore are formed integrally with the cover 205. After the lever has been pivoted over, the closure element is in a non-sealing operating position, as described hereinbefore. Now, in that operating position, the curved portion 230 of the cover 205 can be brought out of engagement with the rolled configuration 32, see FIG. 6*b*. The fixing strip 270 is only glued at its radially outwardly disposed end to the panel 30, in that respect the closure element 205 can be pivoted as a whole and fixed by means of the holding clip 231 to the folded seam of the panel 30. That process is also reversible, that is to say after release of the holding clip 231 from the folded seam of the panel and pivotal movement of the closure element 200 on to the opening, and after the rolled configuration 32 has been brought into engagement with the curved portion 230 of the cover, the lever can be pivoted over again for implementing the operating position in which the container is liquid-tightly and gas-tightly closed.

List of References

10 container body
20 body opening
30 surface portion (end panel)
31 folded seam
32 panel rolled configuration
33 panel sealing surface
40 panel opening
50 insert
51 flange
52 bead
105 closure element, cover
110 bottom portion
120 wall portion
122 cover sealing surface
125 ribs
130 curved portion
150 guide disk
151 contact surface
200 closure device
205 cover
210 bottom portion
211 venting hole
220 wall portion
222 cover sealing surface
223 narrowing wall portion
225 rib
230 curved portion
231 holding clip
250 guide disk
251 contact surface
252 flange-like extension
253 venting hole
260 eccentric lever
261 gripping portion
262 cam head
263 lever spindle
264 fixing lug
265 groove
266 closure surface
270 fixing strip
d1, d2 bottom diameter of the cover
D1, D2 diameter of the opening
r radius
F force vector

The invention claimed is:

1. A closure device for reversibly closing an opening on a container, comprising a deformable stretchable planarly extending cover which can be moved into at least two operating positions, a guide disk which rests on the cover on the side thereof remote from the container and co-operates with the cover, wherein the cover is aligned in a first operating position with the opening of the container and in a second operating position undercuts the opening of the container over the entire periphery with a peripheral edge portion so that the undercutting region on the cover and the undercut region on the container form complementary sealing surfaces for gas-tightly and liquid-tightly closing the opening; and an actuable means for applying a force to the cover for deformation of the cover in such a way that it is deformable from one of the two operating positions into the other operating position, and a means for venting the container comprising a venting passage for the container, which is closed by a valve device, wherein the valve device is operatively connected to the actuating means for applying a force to the cover.

2. A closure device as set forth in claim 1 characterized in that the cover in the first operating position axially extends at least portion-wise into the opening.

3. A closure device as set forth in claim 1 characterized in that the cover in the transition between the two operating positions performs bending deformation without tilting or axial displacement relative to the container opening.

4. A closure device as set forth in claims 1 characterized in that in the first operating position of the cover it is force free.

5. A closure device as set forth in claim 1 characterized in that starting from a first operating position of the cover elastic bending deformation is produced on the cover by the application of an external force to the cover for moving it into a second stationary operating position.

6. A closure device as set forth in claim 5 characterized in that with the removal of the external force on the cover the elastic bending deformation imparted to the cover leads to a return of the cover into its first operating position.

7. A closure device as set forth in claim 1 characterized in that the force means acts permanently on the cover to maintain the second operating position of the cover.

8. A closure device as set forth in claim 1 characterized in that the container edge to provide the opening has an outwardly shaped peripheral rolled portion or a cylinder-like peripheral bead.

9. A closure device as set forth in claim 8 characterized in that the wall portion of the container, at the end remote from a cover bottom portion, goes into a curved portion which bears against the rolled configuration or the bead at the container opening.

10. A closure device as set forth in claim 1 characterized in that the cover in the first operating position is of a pot-like configuration with a bottom portion and a wall portion extending substantially normal to the container opening.

11. A closure device as set forth in claim 10 characterized in that the bottom portion in the first operating position of the cover is shaped concavely towards the interior of the container.

12. A closure device as set forth in claim 1 characterized in that the force means as the actuating element includes a pivotable lever having a gripping portion and a cam head, which exerts a force on the cover independently of the pivotal position of the lever.

13. A closure device as set forth in claim 12 characterized in that the force means produces a force substantially in the normal direction of the opening, which is transmitted to the cover by way of the guide disk.

14. A closure device as set forth in claim 1 characterized by a fixing means with which the closure device is fixed to the container non-losably and independently of the operating position of the cover.

15. A closure device as set forth in claim 1 characterized in that a cam head has a groove which corresponds to the venting passage in dependence on the pivotal position of a lever.

16. A container having an opening for co-operation with a closure device as set forth in claim 1.

17. A container as set forth in claim 16 characterized by a container body having a primary opening which is closed by a primary closure which itself in turn has an opening which is gas-tightly and liquid-tightly closable with the closure device.

18. A container as set forth in claim 16 characterized in that a primary closure is in the form of a surface portion (panel) which is joined to the container body by a folded seam, adhesive or soldering, wherein an inwardly disposed portion of the panel, which portion extends around the opening over the periphery thereof, provides a sealing surface for the portion of the cover, that engages thereover.

19. A container as set forth in claim 16 characterized in that a panel around the opening thereof has a peripherally extending rolled configuration which can be brought into engagement with the closure device.

20. A container as set forth in claim 16 characterized in that the closure device is connected to the container non-losably independently of the operating position of the cover.

21. A closure device selectively opening and closing an opening on a container, comprising a deformable planarly extending cover which can be moved into at least two operating positions, wherein the cover is aligned in a first operating position with the opening of the container and in a second operating position undercuts the opening of the container over the entire periphery with a peripheral edge portion so that the undercutting region on the cover and the undercut region on the container form complementary sealing surfaces for gas-tightly and liquid-tightly closing the opening, the closure device comprising guide elements on the cover, in particular in the region of the transition between a wall portion and a bottom portion, which co-operate with contact surfaces on a guide disk to assist with a spreading movement of the cover;

an actuable means for applying a force to the cover for deformation of the cover in such a way that it is deformable from one of the two operating positions into the other operating position, and a means for venting the container comprising a venting passage for the container, which is closed by a valve device, wherein the valve device is operatively connected to the actuating means for applying a force to the cover.

22. A closure device as set forth in claim 21 characterized in that the guide elements include ribs which extend axially with respect to the opening and which are peripherally spaced on the cover.

* * * * *